US007930913B2

(12) United States Patent
Meyer et al.

(10) Patent No.: US 7,930,913 B2
(45) Date of Patent: Apr. 26, 2011

(54) QUICK-RELEASE RING-TYPE METER LOCK WITH KEYLESS RESET

(75) Inventors: David C. Meyer, Springville, NY (US); Wayne A. Hemmerling, Orchard Park, NY (US); Jeffrey R. Sullivan, Boston, NY (US)

(73) Assignee: McGard, LLC, Orchard Park, NY (US)

( * ) Notice: Subject to any disclaimer, the term of this patent is extended or adjusted under 35 U.S.C. 154(b) by 400 days.

(21) Appl. No.: 11/970,209

(22) Filed: Jan. 7, 2008

(65) Prior Publication Data

US 2009/0173115 A1 Jul. 9, 2009

(51) Int. Cl.
*B65D 55/14* (2006.01)
*E05B 67/36* (2006.01)

(52) U.S. Cl. ..... 70/164; 70/34; 292/256.6

(58) Field of Classification Search ..... 70/158, 70/232, 259, 164–167, 344–346, 14, 32–34; 292/256.6, 256.65, 265.5, 258, 302, 327, 292/4, 57, 59–61
See application file for complete search history.

(56) References Cited

U.S. PATENT DOCUMENTS 1,821,130 A * 9/1931 Wharam ..... 70/259
1,992,531 A * 2/1935 Kaufman ..... 70/90
2,378,638 A * 6/1945 Johnson ..... 411/551
2,478,972 A * 8/1949 Luce ..... 411/551
2,635,317 A * 4/1953 Harley ..... 24/639
3,397,000 A * 8/1968 Nakanishi ..... 292/61
3,415,086 A * 12/1968 Trainor ..... 70/240
3,847,422 A * 11/1974 Gulistan ..... 292/60
4,113,221 A * 9/1978 Wehner ..... 248/408
4,226,102 A * 10/1980 Mattress, Jr. ..... 70/164
4,289,000 A * 9/1981 Nielsen, Jr. ..... 70/34
4,474,041 A * 10/1984 Finck, Jr. ..... 70/159
4,538,775 A * 9/1985 Deissenberger ..... 242/129.51
4,556,244 A * 12/1985 Bisbing ..... 292/65
4,679,835 A * 7/1987 Weinerman et al. ..... 292/197
4,723,866 A * 2/1988 McCauley ..... 404/25
4,809,525 A * 3/1989 Cox ..... 70/100
4,828,300 A * 5/1989 Agbay ..... 292/256.6
5,121,953 A * 6/1992 Mahaney ..... 292/256.6
5,542,722 A * 8/1996 DeWalch ..... 292/256.6
5,868,012 A * 2/1999 Chun-Te et al. ..... 70/30
5,916,279 A * 6/1999 Shieh ..... 70/33
6,296,286 B2 * 10/2001 Glaser et al. ..... 292/198
6,406,074 B1 * 6/2002 Mahaney ..... 292/327
6,439,010 B1 * 8/2002 Julicher ..... 70/164
6,490,892 B1 * 12/2002 Freiman ..... 70/34
6,634,844 B2 * 10/2003 Huber ..... 411/551
6,684,670 B1 * 2/2004 Agbay et al. ..... 70/164
6,742,365 B1 * 6/2004 Sullivan et al. ..... 70/2
6,976,373 B1 * 12/2005 Sullivan et al. ..... 70/2
7,104,092 B2 * 9/2006 Yu ..... 70/21
2004/0093917 A1 * 5/2004 Sullivan et al. ..... 70/164

(Continued)

*Primary Examiner* — Carlos Lugo
*Assistant Examiner* — Alyson M Merlino
(74) *Attorney, Agent, or Firm* — Walter W. Duft

(57) ABSTRACT

A ring-type meter lock comprising a ring, first and second ends on the ring, a lock housing on the first end, a slot in the lock housing, a latch unit in the lock housing, a lock pin on the latch unit enterable and withdrawable from the slot, a tongue on the second end enterable into the slot, an opening in the tongue receiving the lock pin, a key-receiving configuration in the latch unit, and the lock pin being rotatably supported for unlatching of the latch unit.

17 Claims, 7 Drawing Sheets

U.S. PATENT DOCUMENTS * cited by examiner

2006/0254327 A1* 11/2006 Stachowiak, Jr. ..... 70/164
2006/0272369 A1* 12/2006 Stachowiak, Jr. ..... 70/164
2006/0277955 A1* 12/2006 Debrody et al. ..... 70/164

QUICK-RELEASE RING-TYPE METER LOCK WITH KEYLESS RESET

BACKGROUND OF THE INVENTION

1. Field of the Invention

The present invention relates to ring-type meter locks.

2. Description of the Prior Art

By way of background, ring-type meter locks are used to secure meters against tampering. For example, such locks can be used to secure electric utility meters with glass bulbs covering the meter readout area. It is to improvements in ring-type meter locks that the present invention is directed.

SUMMARY OF THE INVENTION

An advance in the art is obtained by a novel ring-type meter lock that may include a ring, first and second ends on the ring, a lock housing on the first end, a slot in the lock housing, a latch unit in the lock housing, a lock pin on the latch unit enterable and withdrawable from the slot, a tongue on the second end enterable into the slot, an opening in the tongue receiving the lock pin, a key-receiving configuration in the latch unit, and the lock pin being rotatably supported for unlatching of the latch unit.

BRIEF DESCRIPTION OF THE DRAWINGS

The foregoing and other features and advantages of the invention will be apparent from the following more particular description of an exemplary embodiment of the invention, as illustrated in the accompanying Drawings, in which.

DETAILED DESCRIPTION OF EXEMPLARY EMBODIMENT

Figure 1:
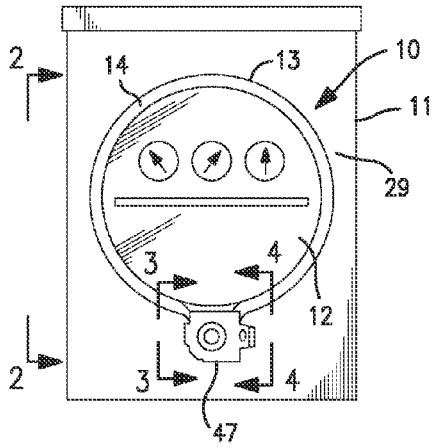
FIG. 1 is a front elevational view showing an electric meter mounting a ring-type meter lock constructed in accordance with the present disclosure.
Figure 2:
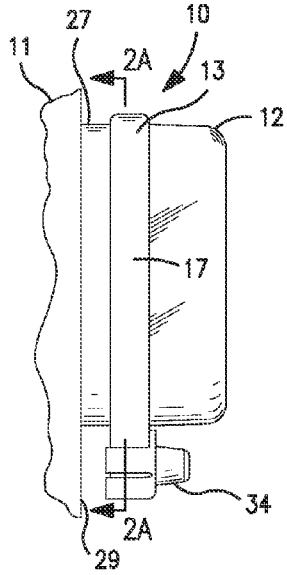
FIG. 2 is a fragmentary side elevational view taken substantially in the direction of arrows 2-2 of FIG. 1.
Figure 3:
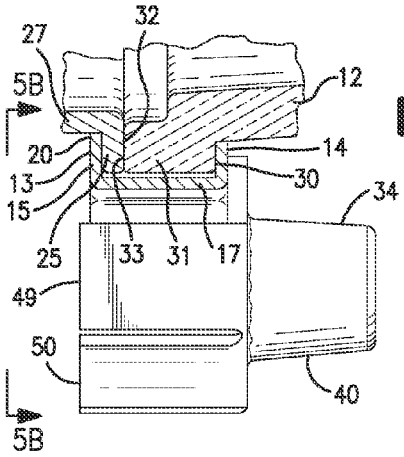
FIG. 3 is a fragmentary cross sectional view taken substantially along line 3-3 of FIG. 1.
Figure 2A:
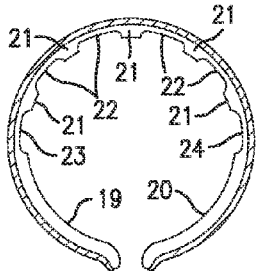
FIG. 2A is a reduced fragmentary cross sectional view of the side of a ring portion of the ring-type meter lock of FIG. 1 taken substantially along line 2A-2A of FIG. 2.
Figure 4:
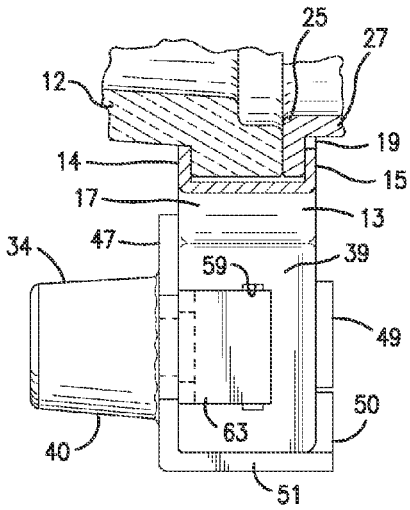
FIG. 4 is a fragmentary cross sectional view taken substantially along line 4-4 of FIG. 1.

Turning now to the drawing figures, wherein like reference numerals represent like structure in all of the several views, a quick-release ring-type meter lock 10 with keyless reset capability (FIG. 5) is shown in FIGS. 1-4 as being mounted on an electric meter 11 having a transparent globe 12 removably secured thereto by meter lock 10. The ring-type meter lock 10 (FIG. 5) includes a curvilinear resilient channel-like ring 13 having a leg or side 14 of substantially uniform width throughout its circumference and a leg 15 connected to leg 14 by web 17. Leg 15 includes two large curvilinear portions 19 and 20 and a plurality of spaced shorter circumferential portions 21 with shorter side portions 22 therebetween. A shorter side portion 23 separates side portions 19 and 21 and a shorter side portion 24 separates side portions 20 and 21. In a locked condition (FIGS. 3 and 4) side portions 19, 20, 21, 22, 23 and 24 engage flange 25 at the outer end of annular portion 27 (FIGS. 2-4) which extends outwardly from the face 29 of meter 11. Leg or side 14 engages side 30 of annular rim 31 of globe 12, and side 32 of flange 25 bears against side 33 of globe rim 31.

Figure 5:
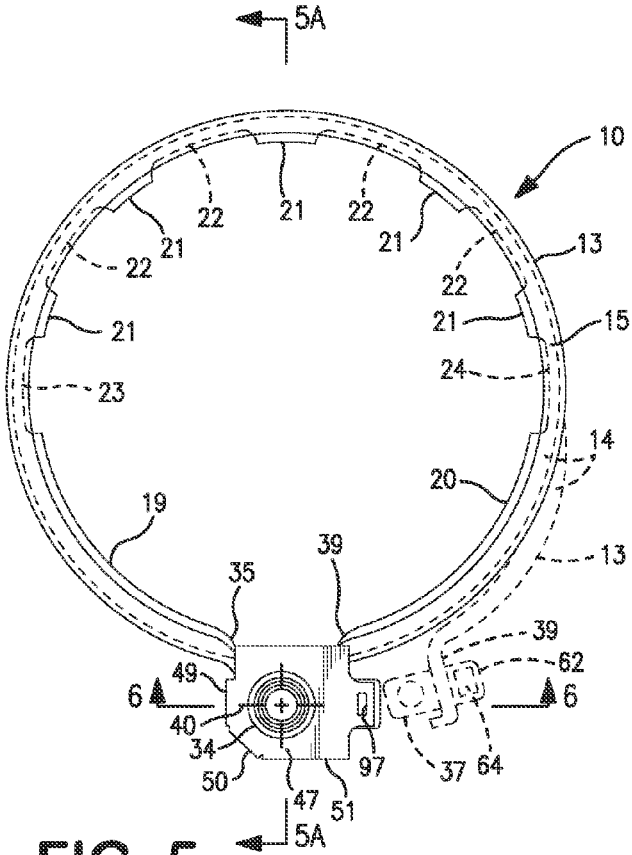
FIG. 5 is a plan view of the ring-type meter lock of FIG. 1 in a locked condition in solid lines and in unlocked condition in dotted lines.
Figure 5A:
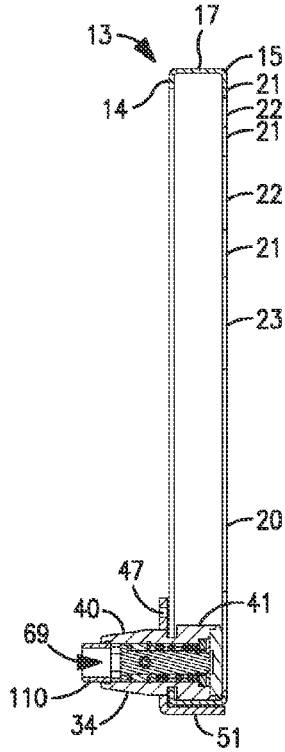
FIG. 5A is a cross-sectional view taken substantially along line 5A-5A of FIG. 5.
Figure 6:
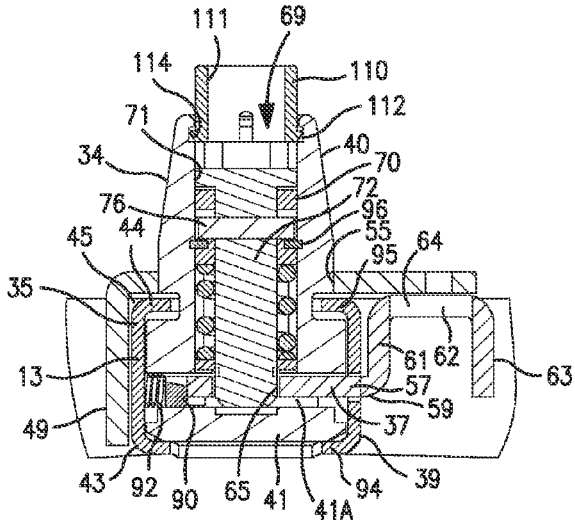
FIG. 6 is an enlarged cross sectional view taken substantially along line 6-6 of the solid lines of FIG. 5.
Figure 7:
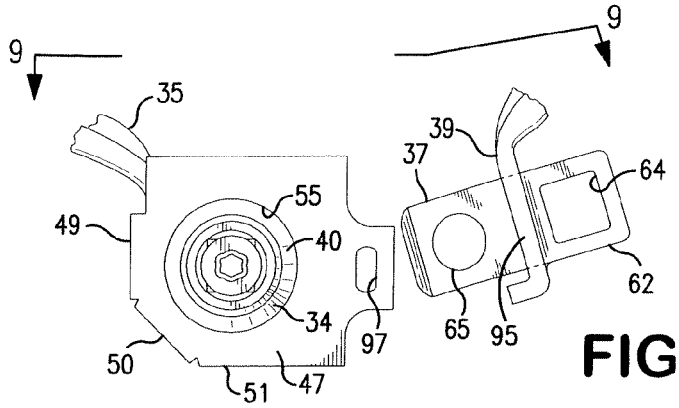
FIG. 7 is an enlarged fragmentary front elevational view showing the lock components of the ring-type meter lock of FIG. 1 in an unlocked condition.
Figure 5B:
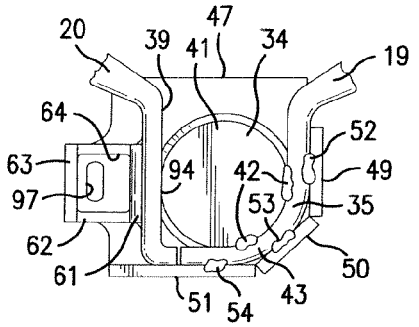
FIG. 5B is a fragmentary rear view of the ring-type meter lock of FIG. 1 in a locked condition taken substantially in the direction of arrows 5B-5B of FIG. 3.
Figure 8:
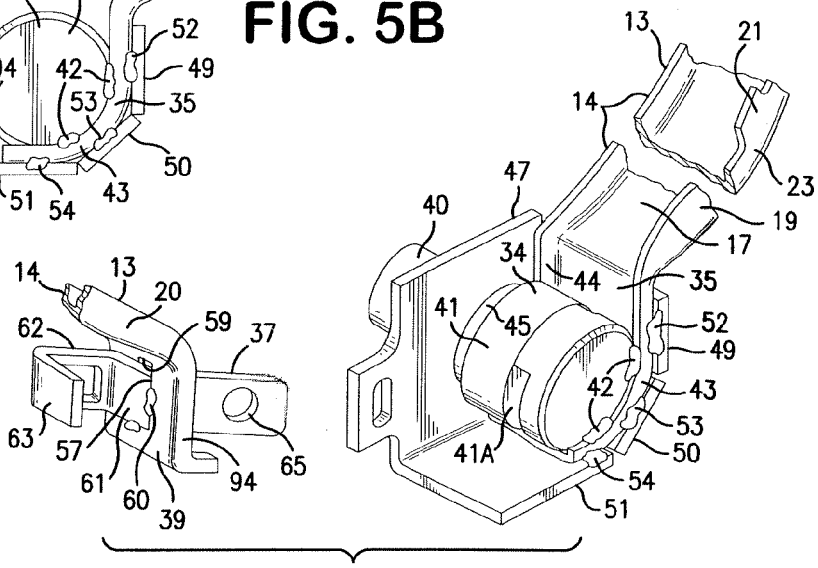
FIG. 8 is a fragmentary perspective view showing the rear of the lock components of the ring-type meter lock of FIG. 1 in an unlocked condition.
Figure 9:
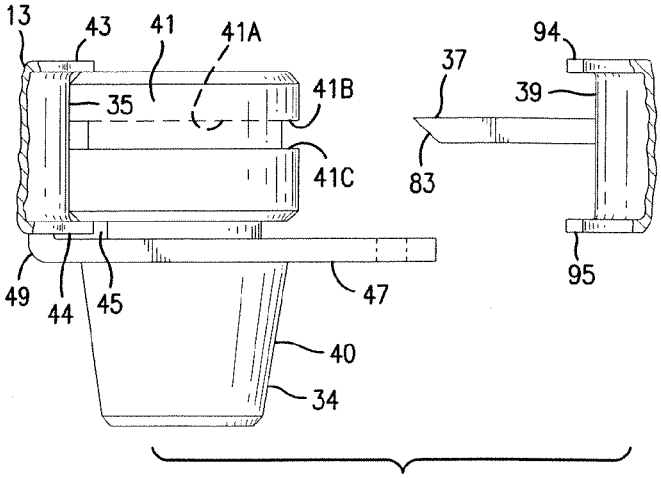
FIG. 9 is an enlarged cross sectional view taken substantially along line 9-9 of FIG. 7.

A lock housing 34 is mounted on end 35 of resilient ring 13, and a tongue 37 is mounted on the opposite end 39 of resilient ring 13 (FIGS. 5 and 7). The lock housing 34 includes a front portion 40 (FIGS. 5 and 7) and a rear portion 41 (FIGS. 5B and 8). The rear portion 41 of housing 34 is welded to end 35 of ring 13 at 42 on flange 43, and flange 44 of end portion 35 is received in annular groove 45 (FIG. 9) which is located between front housing portion 40 and rear housing portion 41. A front plate 47 includes flanges 49, 50 and 51 which extend perpendicularly thereto, and the outer ends of flanges 49, 50 and 51 are welded to flange 43 of end portion 35 at 52, 53 and 54, respectively. The front plate 47 includes a circular cutout 55 (FIGS. 6, 7 and 10) into which the front portion 40 of housing 34 fits.

The tongue 37 is mounted on end 39 of ring 13 in the following manner. A portion 57 (FIGS. 6 and 8) of tongue 37 fits through a slot 59 in ring end 39 and is welded thereto at 60. Tongue 37 also includes a substantially perpendicular portion 61 which extends across the rear of ring end 39, and it includes a portion 62 which extends substantially parallel to main part of tongue 37 and a portion 63 which is substantially parallel to portion 61. An aperture 64 is located in latch portion 62. Tongue 37 also includes a circular opening 65.

Figure 11:
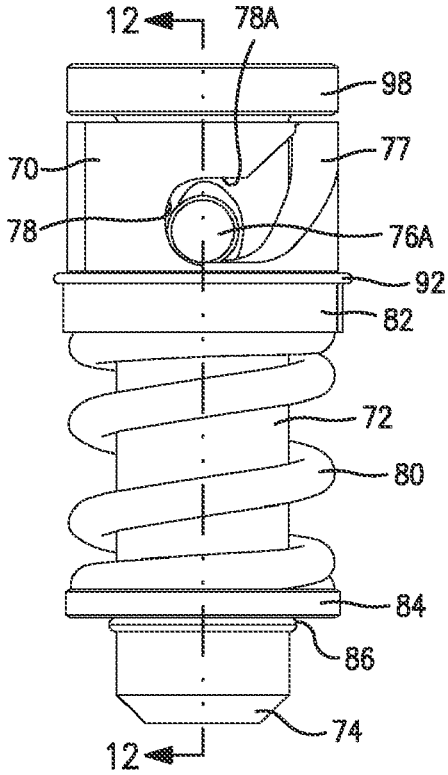
FIG. 11 is a side elevational view of a latch unit of the ring-type meter lock of FIG. 1.
Figure 12:
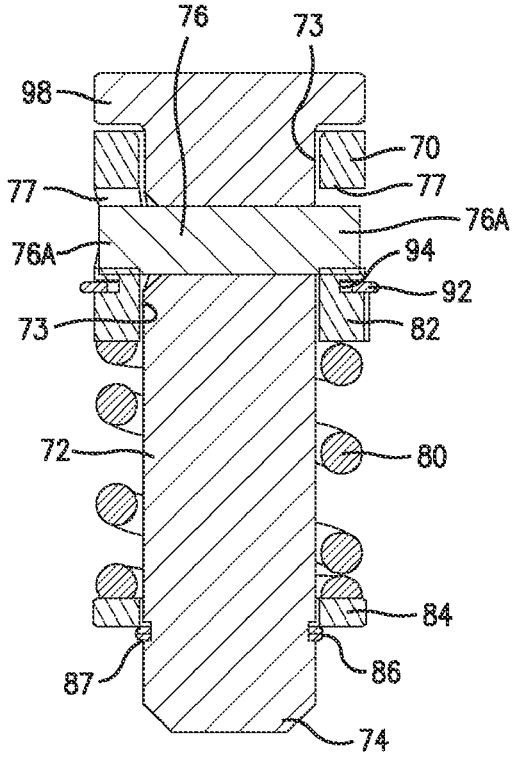
FIG. 12 is a cross sectional view taken substantially along line 12-12 of FIG. 11.

A plunger-type latch unit 69 (FIGS. 6, 10, 11 and 12) is movably positioned in housing portion 40. Latch unit 69 is formed as a cartridge assembly that includes a cam unit 70 that is seated in the bore 71 of housing portion 40. A lock pin (latch) 72 is slideably disposed in the bore 73 of the cam unit 70 and has a chamfered latch head 74 at its bottom end and a transverse cam pin 76 (FIG. 12) near its upper end. Cam pin 76 has cam follower elements 76A that extend from opposite sides of lock pin 72, such that the cam pin is able to ride in a pair of curvilinear cam slots 77 formed on opposite sides of cam unit 70. Each cam slot 77 includes a closed lower end 78 that is formed with an overhang 78A. The overhang 78A traps the cam pin 76 when the lock pin 72 is in its extended latching position and prevents the lock pin from being retracted without lock pin rotation. Applying counterclockwise rotation to the lock pin 72 retracts it to an unlatching position due to the cam pin 76 riding along the cam slots 77. A coil spring 80 biases the lock pin 72 from an unlatched position toward a latching position (downward in FIGS. 10-12) due to the spring being disposed between a base 82 on the cam unit 70 and a washer 84 retained by a split ring retainer 86. The split ring retainer 86 is axially fixed by virtue of being captured in a circular slot 87 formed on lock pin 72. When lock pin 72 is in the unlatched position, the cam pin 76 contacts the upper longitudinally oriented end of the cam slots 77, and when the lock pin is in the latched position the cam pin contacts the closed lower end 78 of the cam slots.

Figure 10:
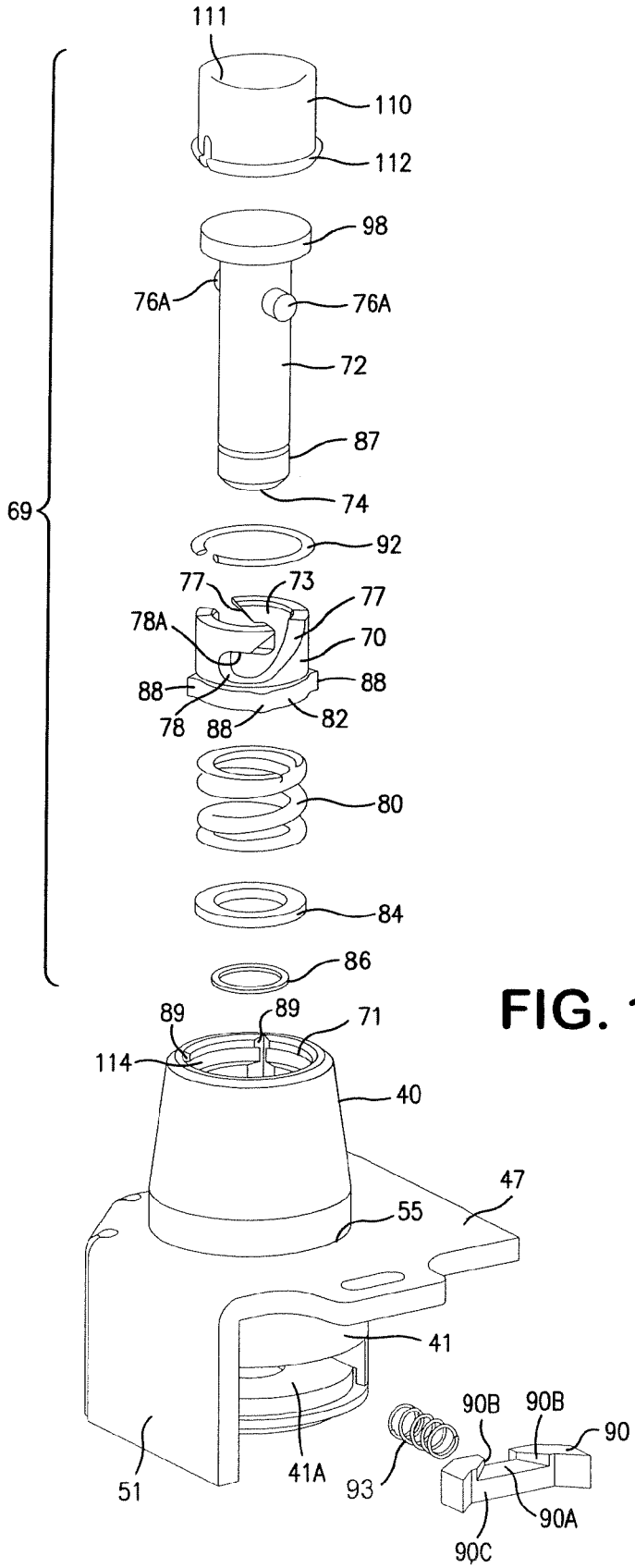
FIG. 10 is an exploded perspective view showing the lock structure of the ring-type meter lock of FIG. 1.

The base 82 of the cam unit 70 includes four prongs 88 (FIG. 10) that slideably engage four corresponding longitudinal slots 89 formed in the bore 71 of housing portion 40. This engagement secures the cam unit 70 against rotation. FIG. 10 also shows a lock pin retaining keeper 90 and associated components situated in slot 41A of housing portion 40. The keeper 90 is described in more detail below. The inner diameter of a second split ring retainer 92 is captured in a circular slot 94 (FIG. 12) formed just above the base 82 of cam unit 70. The outer diameter of the second split ring retainer 92 is captured in a circular slot 96 formed in the bore 71 of housing portion 40 (FIG. 6). Thus, the cam unit 70 is fixed against longitudinal, lateral and rotational movement after it is mounted in the bore 71. Only the lock pin 72 is capable of moving. This movement is along the axis of the bore 71 of housing portion 40. As previously stated, the spring 80 biases the lock pin 72 toward its extended latching position due to the spring being compressed between the base 82 of cam unit 70 and the washer 84. The spring-driven extension of the lock pin 72 relative to cam unit 70 is arrested by virtue of the cam pin 76 and cam follower elements 76A bottoming out on the closed lower end 78 of cam slots 77. Movement of the lock pin 72 in the opposite direction (from its extended latching position to its retracted unlatching position) is also constrained. As lock pin 72 retracts, the cam pin 76 rides in cam slots 77, whose ramp angle transitions from transverse to longitudinal to prevent further lock pin rotation and rise. The spring 80 also becomes substantially fully compressed.

Figure 13:
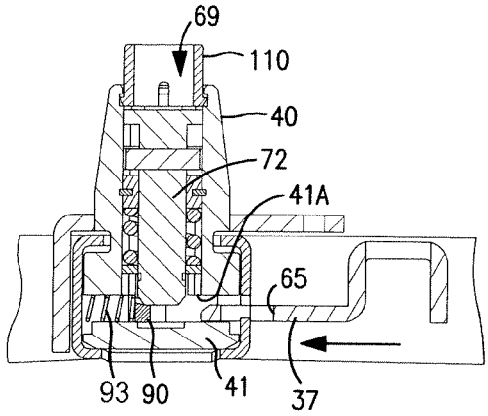
FIG. 13 is a cross sectional view similar to FIG. 6 showing the latch unit and a tongue of the ring-type meter lock of FIG. 1, with the latch unit in a retracted unlatched position and the tongue entering the lock structure housing from an unlocked condition in order to be placed in a locked condition.
Figure 14:
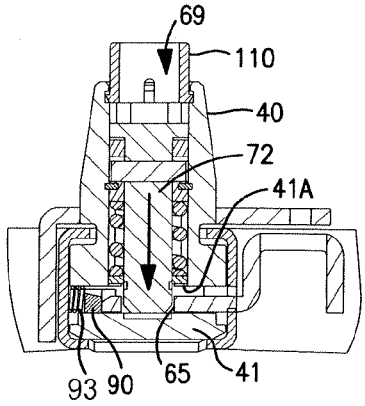
FIG. 14 is a cross sectional view similar to FIG. 13 but showing the latch unit in an extended latched position and the tongue in a locked condition.

The ring 13 can be placed in a locked condition without the use of a key. As noted above, ring 13 is resilient, and when it is in an unlocked condition, the end carrying the tongue 37 will be biased to the dotted line position of FIG. 5. Thus, the ring 13 will be expanded so that it can be mounted about the meter flange 25 and globe rim 31 as described above relative to FIGS. 3 and 4. Thereafter, the end of ring 39 carrying tongue 37 is moved from its dotted line position in FIG. 5 to its solid line position against the resilience of the ring so that tongue 37 will enter slot 41A (FIGS. 8, 9, 10) of housing portion 41. This position is shown in FIG. 13. Lock pin 72 is enterable into and withdrawable from slot 41A. The beveled tip 83 (FIG. 9) of tongue 37 may engage the chamfered end 74 of lock pin 72 as the tongue is guided between walls 41B and 41C of slot 41A, depending on the position of the lock pin 72. Whether or not this engagement occurs is dependent on the retracted position of the lock pin 72. This position is determined by a keeper 90 (best shown in FIG. 10) that is slideably disposed in slot 41A, and upon which lock pin 72 rests when in the retracted position. Ideally, keeper 90 is sized so that tongue 37 does not need to engage lock pin 72 as it advances in slot 41A. However, manufacturing tolerances may be such that tongue 37 does in fact contact lock pin 72. In that event, beveled tip 83 of tongue 37 will slideably engage the tip of lock pin 72 and further retract it to allow the tongue to advance. The keeper 90 is biased toward the open end of slot 41A by a spring 93. As best shown in FIG. 10, the keeper 90 includes a land 90A on which lock pin 72 rests in the unlatched position of FIG. 13. A pair of sidewalls 90B extending from land 90A engage lock pin 72 to prevent the land from sliding out of position due to the biasing force of spring 93. As tongue 37 is advanced in slot 41A from the unlatched position of FIG. 13 toward the latched position of FIG. 14, the tip of the tongue will ultimately engage front surface 90C of keeper 90 (FIG. 10). Continued advancement of tongue 37 retracts keeper 90 until it no longer blocks lock pin 72 from extending to the latched position. However, when this point is reached, lock pin 72 will be supported on the forward end of tongue 37 and will remain refracted. Further advancement of tongue 37 continues to displace keeper 90 and brings the opening 65 in the tongue to a position in which it lines up with lock pin 72. At this point, due to the biasing force of lock pin spring 80 (FIGS. 10-12), lock pin 72 is free to snap to its full latching position in which the tongue is captured in slot 41A (FIG. 14). In the latched position, the tongue 37 cannot be withdrawn because lock pin 72 extends completely through tongue opening 65.

When tongue 37 is in the above-described locked position with lock pin 72 engaging tongue opening 65, flanges 94 and 95 (FIG. 9) of ring end 39 will occupy the positions shown in FIG. 6 wherein flange 95 is received within annular groove 45 and flange 94 is located at the rear of rear housing portion 41 in opposition to flange 43 of ring end 35. At this time opening 64 in tongue portion 62 will be aligned with slot 97 of front plate 47 (FIG. 7) so that a wire-type of locking seal can be placed through slot 97 and opening 64 to prevent unlatching of the lock without destroying the seal.

Figure 15:
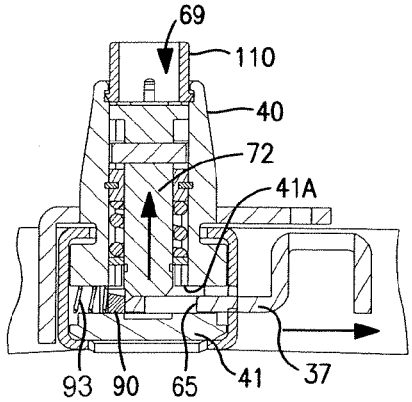
FIG. 15 is a view similar to FIG. 14 but showing the latch in the unlatched position and the tongue released therefrom and beginning to move.
Figure 16:
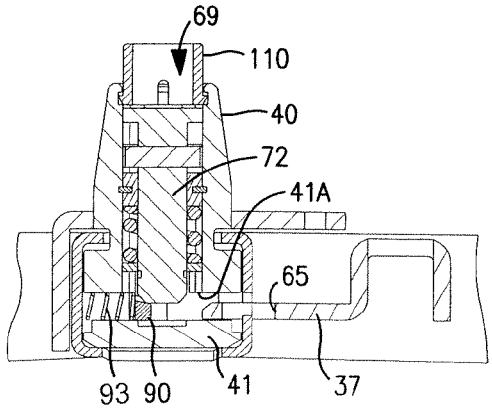
FIG. 16 is a view similar to FIG. 15 but showing the tongue leaving the lock structure housing.

The ring-type meter lock 10 is unlocked to its position of FIGS. 15 and 16 from its locked position of FIG. 14 by utilizing a key 99 having a curvilinear ridge 100 (FIG. 17) at the end of stem 101. Curvilinear ridge 100 is of a configuration to mate with curvilinear groove 102 (FIG. 18) in the face 103 of lock pin head 98. Advantageously, the design of the latch unit 69 provides a quick-release capability. In particular, lock pin 72 only needs to be rotated a small amount in order to completely retract to the unlatched position of FIG. 16. The amount of rotation required to retract the lock pin is determined by the pitch of cam slots 77 (FIG. 10), and may be varied according to design requirements. In order to provide quick-release operation, the amount of required rotation during the unlocking operation (e.g., using the key of FIG. 17) preferably does not exceed the normal range of human wrist rotation. This normal range of wrist rotation typically does not exceed approximately 180 degrees for most people, although for some persons the rotational limit could be higher, perhaps as much as 270 degrees. With additional arm and shoulder rotation, a person might even achieve 360 degrees rotation, but usually no more than that. A preferred amount of rotation required to retract the lock pin is less than approximately 180 degrees. More preferably, the required rotation is less than approximately 90 degrees, and most preferably is less than approximately 45 degrees. For example, in the illustrated embodiment the required rotation is approximately 25-30 degrees. Preferably, cam slots 77 are designed to provide a consistent opening torque. When lock pin 72 is fully retracted, it no longer engages tongue opening 65. At this point, the natural resilience of ring 13 will cause tongue 37 to be withdrawn from housing 34 to the position shown in dotted lines in FIG. 5. Keeper 90 provides an additional withdrawing force due to spring 93, As tongue 37 withdraws, keeper 90, which is retained in position by the tip of tongue 37, is free to extend under the biasing force of the spring 93. When the ring 13 is in the dotted line position of FIG. 5, it can be removed from engagement with the globe 12 and the meter 11 so that the globe can be removed from its mounted position.

Advantageously, latch unit 69 does not need to be reset and may be relatched without the use of a key in the manner described above when tongue 37 is inserted into slot 41A. This is due to keeper 90 being automatically set in position under lock pin 72 during the unlatching procedure. In particular, once lock pin 72 rotated to its unlatched position, tongue opening 65 is free of the lock pin and tongue 37 begins to withdraw from slot 41A due to the natural resilience of ring 13 in combination with the spring bias of keeper 90. Initially during this time period, the portion of tongue 37 between tongue opening 65 and the tip of the tongue supports lock pin 72 in the retracted position. As tongue 37 continues to withdraw from slot 41A, but before tongue 37 completely disengages from lock pin 72, land 90A of keeper 90 slides under lock pin 72 and takes over from tongue 37 as the retaining agent that retains the lock pin in its retracted position. This transition may be seen by comparing FIG. 15 (lock pin supported on tongue) to FIG. 16 (lock pin supported on keeper). The latch unit 69 is thus ready to be relatched at any time per FIGS. 13-14 and the discussion above.

Figure 17:
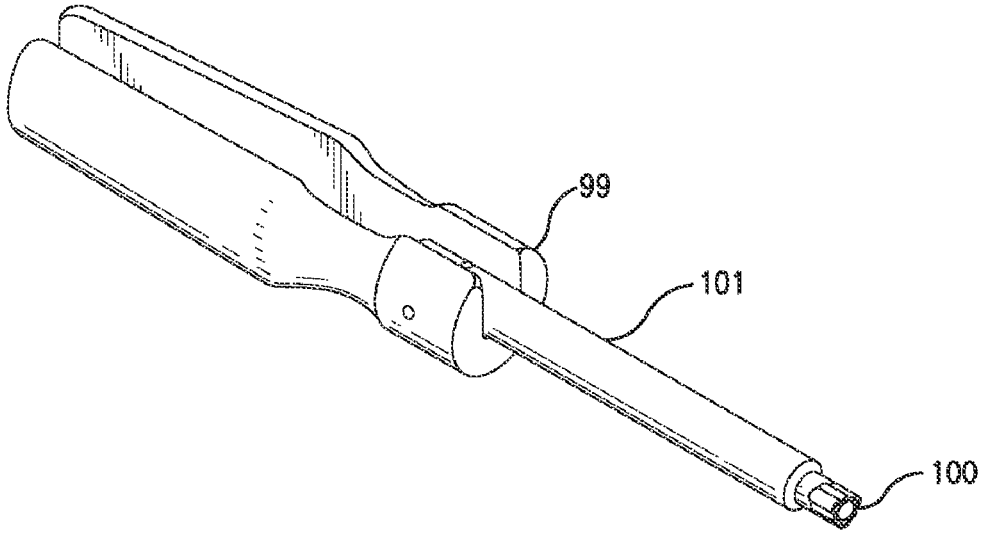
FIG. 17 is a perspective view of a security key tool that may be used to unlock the ring-type meter lock of FIG. 1.
Figure 18:
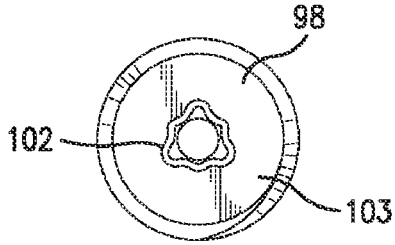
FIG. 18 is an end view of the latch unit of FIG. 11.

As shown in FIGS. 5A, 6, 10 and 13-16, a ring-lock key guide 110 fits into the front portion 40 of lock housing 34 and acts as a guide for the stem 101 of key 101 of key 99 (FIG. 17). More specifically, the key guide 110 includes a hollow cylindrical body 111 having an annular collar 112 thereon. Collar 112 is received in annular groove 114 of front portion 40 of lock housing 34. The ring-lock key guide 110 is fabricated of flexible plastic material which permits the collar 112 to distort during the installation process, and it thereafter snaps back into its annular shape to retain the ring-lock key guide 110 in position.

Accordingly, a quick-release ring-type meter lock with keyless reset has been disclosed. Although an exemplary embodiment has been shown and described, it should be apparent that many variations and alternative embodiments could be implemented in accordance with the teachings herein. It is understood, therefore, that the invention is not to be in any way limited except in accordance with the spirit of the appended claims and their equivalents.

What is claimed is:

1. A ring-type meter lock comprising a ring, first and second ends on said ring, a lock housing on said first end of said ring, a slot in said lock housing, a bore in said lock housing extending from a bore entrance to said slot, a latch unit in said lock housing bore, said latch unit including a cam unit having a cam unit bore that carries a lock pin having a first end and a second end, said first end of said lock pin being situated within said lock housing bore entrance such that only a first end face of said lock pin is accessible via said lock housing bore entrance, said second end of said lock pin being enterable into and withdrawable from said slot via said lock housing bore, a tongue on said second end of said ring enterable into said slot, an opening in said tongue arranged to receive said second end of said lock pin when said tongue is at a predetermined position in said slot, thereby latching said tongue, a key-receiving configuration on said first end face of said lock pin for receiving a security key that rotates said lock pin, said cam unit further including at least one cam surface on which said lock pin is rotatably supported, said cam unit and said at least one cam surface being fixedly positioned in said lock housing, said lock pin being resiliently biased by a biasing element of said latch unit for movement within said cam unit bore from an unlatching position wherein said second end of said lock pin is not received in said opening of said tongue and wherein said lock pin engages a first part of said at least one cam surface in a first rotational orientation toward a latching position wherein said second end of said lock pin is received in said opening of said tongue and wherein said lock pin engages a second part of said at least one cam surface in a second rotational orientation, and said first part of said at least one cam surface having a curvilinear portion that causes said lock pin to continuously translate during movement between said latching position and said unlatching position as said lock pin is rotated.

2. A ring-type meter lock as set forth in claim 1, wherein said cam unit includes a at least one cam slot that provides said at least one cam surface and said lock pin includes a cam follower that rides in said at least one cam slot.

3. A ring-type meter lock as set forth in claim 1, wherein said cam unit includes a pair of opposing curvilinear cam slots that provide said at least one cam surface and wherein said lock pin includes a pair of cam follower elements that ride in said cam slots.

4. A ring-type meter lock as set forth in claim 3, wherein said cam slots include a closed lower end that is formed with an overhang that traps said cam followers when said lock pin is in said latching position to prevent said lock pin from being retracted without lock pin rotation by a security key engaging said key-receiving configuration, said overhang being oblique to said curvilinear portion of said at least one cam surface such that rotation without translation of said lock pin from said latching position is required before said lock pin cam follower elements enter said curvilinear portion of said at least one cam surface and said lock pin begins to translate toward said unlatching position.

5. A ring-type meter lock as set forth in claim 1, wherein said at least one cam surface is configured so that not more than approximately 180 degrees rotation is required to withdraw said lock pin to said unlatching position.

6. A ring-type meter lock as set forth in claim 1, wherein said at least one cam surface is configured so that not more than approximately 90 degrees rotation is required to withdraw said lock pin to said unlatching position.

7. A ring-type meter lock as set forth in claim 1, wherein said at least one cam surface is configured so that an opening torque to unlatch said latch unit is substantially uniform.

8. A ring-type meter lock as set forth in claim 1, wherein said latch unit biasing element includes a spring that biases said lock pin to said latching position.

9. A ring-type meter lock as set forth in claim 1, further including a keeper in said slot adapted to maintain said lock pin in said unlatching position when said tongue is withdrawn from said slot.

10. A ring-type meter lock as set forth in claim 9, wherein said keeper is slideably disposed in said slot between an extended position wherein said keeper engages said lock pin and a retracted position wherein said keeper does not engage said lock pin.

11. A ring-type meter lock as set forth in claim 9, wherein said keeper is resiliently biased toward said keeper extended position.

12. A ring-type meter lock as set forth in claim 11, wherein said keeper is configured with at least one sidewall to engage a side portion of said lock pin in said keeper extended position in order to prevent said keeper from being biased out of engagement with said lock pin.

13. A ring-type meter lock as set forth in claim 12, wherein said keeper is positioned to be engaged by said tongue and urged to said keeper retracted position when said tongue is latched by said latch unit.

14. A ring-type meter lock as set forth in claim 13, wherein said keeper exert an opening force on said tongue as a result of said keeper being resiliently biased.

15. A ring-type meter lock, comprising a ring, first and second ends on said ring, a lock housing on said first end, a slot in said lock housing, a latch unit in said lock housing, said latch unit including a lock pin that is enterable into and withdrawable from said slot, said lock pin being resiliently biased toward said slot by a resilient biasing force, a tongue on said second end enterable into said slot, an opening in said tongue receiving said lock pin in a latching position, a key-receiving configuration on said lock pin, and said lock pin having at least one cam follower that is rotatably supported on at least one cam surface in a cam unit within said lock housing for unlatching of said latch unit after not more than approximately 180-270 degrees rotation of said lock pin, said rotation being opposed by said biasing force, and wherein said at least one cam surface is configured with an overhang that transitions to a curvilinear portion of said at least one cam surface, said overhang being oblique to said curvilinear portion such that initial rotation of said lock pin from said latching position toward an unlatching position produces no translation of said lock pin while said at least one cam follower engages said overhang, said lock pin thereby being prevented from translating without a security key engaging said key-receiving configuration and providing the proper force to rotate said lock pin until said at least one cam follower reaches said curvilinear portion and said lock pin begins to translate toward said unlatching position.

16. A ring-type meter lock as set forth in claim 15, wherein said lock pin is rotatably supported for unlatching of said latch unit after not more than approximately 90 degrees rotation of said lock pin.

17. A ring-type meter lock comprising:

a ring;

first and second ends on said ring;

a lock housing on said first ring end;

a slot in said lock housing;

a latch unit in said lock housing;

said latch unit including a spring-biased lock pin that is enterable into and withdrawable from said slot;

a tongue on said second ring end enterable into said slot;

an opening in said tongue arranged to receive said lock pin when said tongue is at a predetermined position in said slot and said lock pin has entered said slot in a latching position;

a key-receiving configuration in said latch unit;

at least one cam surface on which said lock pin is rotatably supported for unlatching of said latch unit;

said latch unit including a cam unit that provides said at least one cam surface and has a bore that slidably receives said lock pin;

said cam unit including a pair of opposing curvilinear cam slots providing said at least one cam surface and said lock pin including cam elements that ride in said cam slots;

said cam slots including a closed lower end that is formed with an overhang that traps said cam followers when said lock pin is in said latching position to prevent said lock pin from being refracted without lock pin rotation;

said cam unit being fixed against rotation in said lock housing;

said cam slots being configured so that not more than 90 degrees rotation is required to withdraw said lock pin to an unlatching position in which said lock pin is not received in said opening of said tongue;

said cam slots being further configured so that an opening torque to unlatch said latch unit is substantially uniform;

a spring that biases said lock pin to its latching position;

a keeper in said slot that maintains said lock pin in said unlatching position when said tongue is withdrawn from said slot;

said keeper being slideably disposed in said slot between an extended position wherein said keeper engages said lock pin and a retracted position wherein said keeper does not engage said lock pin;

said keeper being resiliently biased toward said keeper extended position;

said keeper being configured with at least one sidewall that engages a side portion of said lock pin in said keeper extended position in order to prevent said keeper from being biased out of engagement with said lock pin;

said keeper being positioned to be engaged by said tongue and urged to said keeper refracted position when said tongue is latched by said latch unit; and said keeper exerting an opening force on said tongue as a result of said keeper being resiliently biased.

* * * * *